US007171952B2

(12) United States Patent
Joos et al.

(10) Patent No.: US 7,171,952 B2
(45) Date of Patent: Feb. 6, 2007

(54) METHOD, COMPUTER PROGRAM, CONTROL AND/OR REGULATION DEVICE FOR OPERATION OF AN INTERNAL COMBUSTION ENGINE AND FUEL SYSTEM FOR AN INTERNAL COMBUSTION ENGINE

(75) Inventors: Klaus Joos, Walheim (DE); Jens Wolber, Gerlingen (DE); Thomas Frenz, Noerdlingen (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 233 days.

(21) Appl. No.: 10/487,112

(22) PCT Filed: Jul. 26, 2002

(86) PCT No.: PCT/DE02/02783

§ 371 (c)(1),
(2), (4) Date: Feb. 19, 2004

(87) PCT Pub. No.: WO03/027469

PCT Pub. Date: Apr. 3, 2003

(65) Prior Publication Data

US 2004/0237937 A1 Dec. 2, 2004

(30) Foreign Application Priority Data

Sep. 12, 2001 (DE) ..... 101 44 800

(51) Int. Cl.
*F02M 69/54* (2006.01)
*F02M 69/52* (2006.01)

(52) U.S. Cl. ..... 123/457; 123/456; 123/198 D

(58) Field of Classification Search ..... 123/457, 123/456, 462, 447, 506, 198 D, 461; 73/119
See application file for complete search history.

(56) References Cited

U.S. PATENT DOCUMENTS

| | | | | |
|---|---|---|---|---|
| 5,283,548 | A * | 2/1994 | Kanno | 340/439 |
| 5,678,521 | A | 10/1997 | Fridholm et al. | |
| 5,785,025 | A | 7/1998 | Isomura et al. | |
| 6,092,509 | A * | 7/2000 | Tanabe et al. | 123/447 |
| 6,125,832 | A | 10/2000 | Toyohara et al. | |
| 6,192,862 | B1 * | 2/2001 | Tanabe et al. | 123/447 |
| 6,363,914 | B1 * | 4/2002 | Tanabe et al. | 123/447 |
| 6,457,453 | B1 * | 10/2002 | Tanabe et al. | 123/300 |
| 6,543,420 | B2 * | 4/2003 | Kohketsu et al. | 123/447 |
| 6,684,856 | B2 * | 2/2004 | Tanabe et al. | 123/447 |
| 6,772,738 | B2 * | 8/2004 | Rembold et al. | 123/514 |

FOREIGN PATENT DOCUMENTS

| | | |
|---|---|---|
| DE | 195 39 883 A | 11/1996 |
| DE | 196 26 689 C1 | 11/1997 |
| DE | 197 57 594 | 7/1999 |
| EP | 1 118 761 A | 7/2001 |

* cited by examiner

*Primary Examiner*—Mahmoud Gimie
(74) *Attorney, Agent, or Firm*—Michael J. Striker

(57) ABSTRACT

An internal combustion engine is operated according to a method, in which the fuel is pumped from a first fuel pump to a second fuel pump and from there into a high-pressure region. The fuel passes therefrom into at least one combustion chamber of the internal combustion engine, by means of at least one fuel injection device. In certain operating conditions of the internal combustion engine, the pressure in the high-pressure region is lowered by means of a release device. According to the invention, the reliability and security of operating the internal combustion engine may be increased by monitoring the functioning of the release device (58 through 68).

13 Claims, 6 Drawing Sheets

METHOD, COMPUTER PROGRAM, CONTROL AND/OR REGULATION DEVICE FOR OPERATION OF AN INTERNAL COMBUSTION ENGINE AND FUEL SYSTEM FOR AN INTERNAL COMBUSTION ENGINE

BACKGROUND INFORMATION

The present invention relates to a method for operating an internal combustion engine, in which the fuel is pumped from a first fuel pump to a second fuel pump and, from there, into a high-pressure region, from where the fuel passes into at least one combustion chamber of the internal combustion engine via at least one fuel injection device, and in which the pressure in the high-pressure region is lowered in certain operating conditions of the internal combustion engine by means of a release device.

A method of this type is made known in DE 195 39 883 A1. According to that publication, when the internal combustion engine is switched off, pressure compensation is established between the pressure side of the second fuel pump and a fuel tank and/or ambient pressure. This is carried out via a fuel line in which a valve is located, the valve being configured as a pressure-control valve when in the energized operating position, and as a flow restrictor when in the de-energized operating position. Systems are also known in which only a flow restrictor is provided.

These measures serve to effectively prevent fuel from passing into the combustion chambers of the internal combustion engine through the fuel injection devices after the internal combustion engine is switched off. This unburned fuel would result in increased emissions when the internal combustion engine is started.

The release device has other advantages as well: it prevents fuel from passing from the fuel injection devices into the internal combustion chamber of the internal combustion engine when the internal combustion engine operates in overrun, and it prevents an impermissible pressure increase in the high-pressure region after the internal combustion engine is switched off, which is caused by heat being conducted from the engine block and warming the fuel that is located in the high-pressure region. In addition, a pressure limiter, which limits the pressure in the high-pressure region, can also be configured with a simpler design due to the release device that is proposed. Furthermore, if maintenance must be performed, the pressure can be relieved on the pressure side in a simple manner so that parts can be safely removed, if necessary. In addition, when the pressure is reduced, pressure dynamic properties are improved.

During operation of the internal combustion engine, however, it was determined that difficulties during start-up of the internal combustion engine and an impermissibly high pressure increase in the high-pressure region cannot always be ruled out with absolute certainty.

SUMMARY OF THE INVENTION

The object of the present invention, therefore, is to further develop a method of the type described initially such that reliability is increased during operation of the internal combustion engine.

This object is achieved in the case of a method of the type described initially by monitoring the functioning of the release device.

By monitoring the functioning of the release device, situations may be detected in which the pressure in the high-pressure region cannot be lowered using the release device, or it cannot be lowered in the desired manner. However, a faulty release device must be detected so that the fault can be eliminated as quickly as possible and/or to ensure that the internal combustion engine is not operated in a manner in which excessive pressure in the high-pressure region caused by the malfunctioning release device impairs the operation of the internal combustion engine or damages components of the internal combustion engine.

Monitoring the functioning of the release device therefore makes it possible to improve the reliability of the internal combustion engine.

In a first particularly preferred further development of the method according to the invention, it is proposed that the gradient according to which the pressure in the high-pressure region drops, due to the release device, in a certain operating condition of the internal combustion engine is monitored. The primary advantage of this further development is that the functioning of the release device can be monitored without the need for additional components. Specifically, the pressure in the high-pressure region is detected immediately by a pressure sensor. This pressure sensor is located, in general, on a fuel manifold ("rail") in the high-pressure region.

As a further development thereof, it is proposed that the period of time, within which the pressure in the high-pressure region drops by a certain value in a certain operating condition of the internal combustion engine, is monitored. Alternatively, it is possible to monitor the pressure differential by which the pressure in the high-pressure region drops within a specified period of time in a certain operating condition of the internal combustion engine. Both of these method enhancements are simple to implement.

It is possible as well, however, that the volumetric flow in the high-pressure region, which exists due to the action of the release device in a certain operating condition of the internal combustion engine, is monitored. This further development is advantageous in operating conditions in which the fuel injection devices do not deliver any fuel into the combustion chambers of the internal combustion engine, but, at the same time, the pressure in the high-pressure region must be held constant at a certain value. This is accomplished by the fact that the quantity of fuel that flows through the release device from the high-pressure region is replaced in the high-pressure region by the second fuel pump. The volumetric flow that is delivered from the second fuel pump is therefore a criterium for the functioning of the release device.

In a particularly preferred further development of the method according to the invention, it is also proposed that the volumetric flow is determined based on the activation of a quantity control valve, with which the quantity of fuel delivered from the second fuel pump can be adjusted. The advantage of this further development of the method according to the invention is that the volumetric flow can be determined without the need for additional components. The corresponding internal combustion engine is therefore relatively economical to build.

The stated quantity control valve can connect the working space of the second fuel pump during a delivery phase with the region that is located upstream of the second fuel pump. During the opening time of the quantity control valve, the fuel from the second fuel pump is therefore not delivered to the high-pressure region. Instead, it is delivered back to the region that is located upstream of the second fuel pump. The quantity of fuel that is subsequently delivered from the second fuel pump to the high-pressure region can therefore be determined based on the duration of opening of the quantity control valve during the delivery phase of the second fuel pump. The duration of opening, in turn, is based on the activation times of the quantity control valve.

It is further proposed that, if the gradient or the pressure differential or the volumetric flow is less than a limiting value, or if the time is greater than a limiting value, then a fault is entered in the fault storage, and/or a warning signal is generated. The fault that is entered in the fault storage can be read out during maintenance, for example, thereby providing immediate information about the malfunction of the release device. The fault can therefore be purposefully eliminated, which enhances the reliability of the internal combustion engine. The warning signal notifies the operator of the malfunction, so that the operator can take the malfunctioning of the release device into account during operation of the internal combustion engine. This serves to enhance reliability and security during operation of the internal combustion engine as well.

It is also possible that, when a fault is entered in the fault storage, functions that rely on the correct functioning of the release device are shut off. These functions include, for instance, the diagnosis of a shutoff valve that is located in a leakage conduit, which is connected between the second fuel pump and the fuel tank. The measure according to the invention prevents this diagnosis from yielding an incorrect result.

The operating conditions of the internal combustion engine, in which the release device is monitored, include an overrun condition and/or a condition in which the internal combustion engine is switched off. In the overrun condition, despite the fact that the second fuel pump is running, no fuel is injected from the fuel injection devices into the combustion chambers. The fuel can therefore flow out of the high-pressure region only via the release device. The same applies as well for the condition in which the internal combustion engine is switched off. Both operating conditions are therefore well-suited for the monitoring of the release device.

In a particularly advantageous further development of the method according to the invention, the level of the limiting value that is used for monitoring is a function of the operating condition and/or at least one operating variable of the internal combustion engine. As a result of this, for instance, the fact that the viscosity of the fuel is a function of its temperature can be taken into account.

The rate at which the fuel flows through the release device from the high-pressure region is therefore a function of temperature as well.

Moreover, in the overrun condition, the pressure that prevails in the high-pressure region can be a function of the rotational speed of the internal combustion engine. This has to do with the fact that the second fuel pump is usually driven by the camshaft of the internal combustion engine. Although, in overrun, the second fuel pump does not deliver any fuel, or delivers only a small quantity of fuel into the high-pressure range due to a corresponding activation of the quantity control valve, the pressure in the high-pressure region is still greater than in the idling, second fuel pump, and is a function of the rotational speed of the second fuel pump.

The present invention also relates to a computer program that is suited to carrying out the method described herein above, when the method is carried out on a computer. It is particularly preferable for the computer program to be stored in a memory, in particular in Flash memory or a ferrite RAM.

The present further relates to a control and/or regulating device for operating an internal combustion engine. In order to make the operation of the internal combustion engine even more secure and reliable, it is proposed that the control and/or regulating device include a memory, in which a computer program of the type described herein above is stored.

The present invention further relates to a fuel system for an internal combustion engine, including a first fuel pump, a second fuel pump, which is connected with the first fuel pump on the intake side, and a high-pressure region, which is connected with the outlet of the second fuel pump, whereby the high-pressure region has at least one fuel injection device, and including a release device for lowering the pressure in the high-pressure region in certain operating conditions of the internal combustion engine.

In order to be able to operate the internal combustion engine securely and reliably, it is proposed that a control and/or regulating device is provided, which monitors the functioning of the release device.

In an advantageous further development it is proposed that the release device includes a flow restrictor. A flow restrictor of this type functions reliably and is economical to manufacture.

It is also possible for the release device to include an electrically actuated valve. The electrically actuated valve can be a simple electrical shutoff valve, for example, which opens when de-energized. During normal operation of the internal combustion engine, this prevents fuel from flowing out of the high-pressure region. On the other hand, a rapid pressure drop in the high-pressure region is ensured in certain operating conditions.

It is particularly preferred when the release device joins the high-pressure region with a fuel tank or with a region that is located between the first and second fuel pumps. A connection with the fuel tank results in a pressure drop, to ambient pressure, in the high-pressure region in the certain operating conditions of the internal combustion engine. As a result, the load on the components in the high-pressure region is effectively reduced.

A connection between the high-pressure region and the region that is located between the first and second fuel pumps enables pressure in the high-pressure region to be maintained at the same level as the pressure that exists between the first and second fuel pumps. This pressure is maintained at the level of the normal operating pressure of the first fuel pump in overrun and when the internal combustion engine is switched off, in order to prevent the formation of vapor bubbles. The load on the components in the high-pressure region is effectively reduced in this case as well, while the formation of vapor bubbles in the high-pressure region is simultaneously suppressed, and the starting response of the internal combustion engine is improved.

BRIEF DESCRIPTION OF THE DRAWINGS

Particularly preferred exemplary embodiments of the invention are explained herein below with reference to the attached drawing, whose figures show.

DESCRIPTION OF THE PREFERRED EMBODIMENTS

Figure 1:
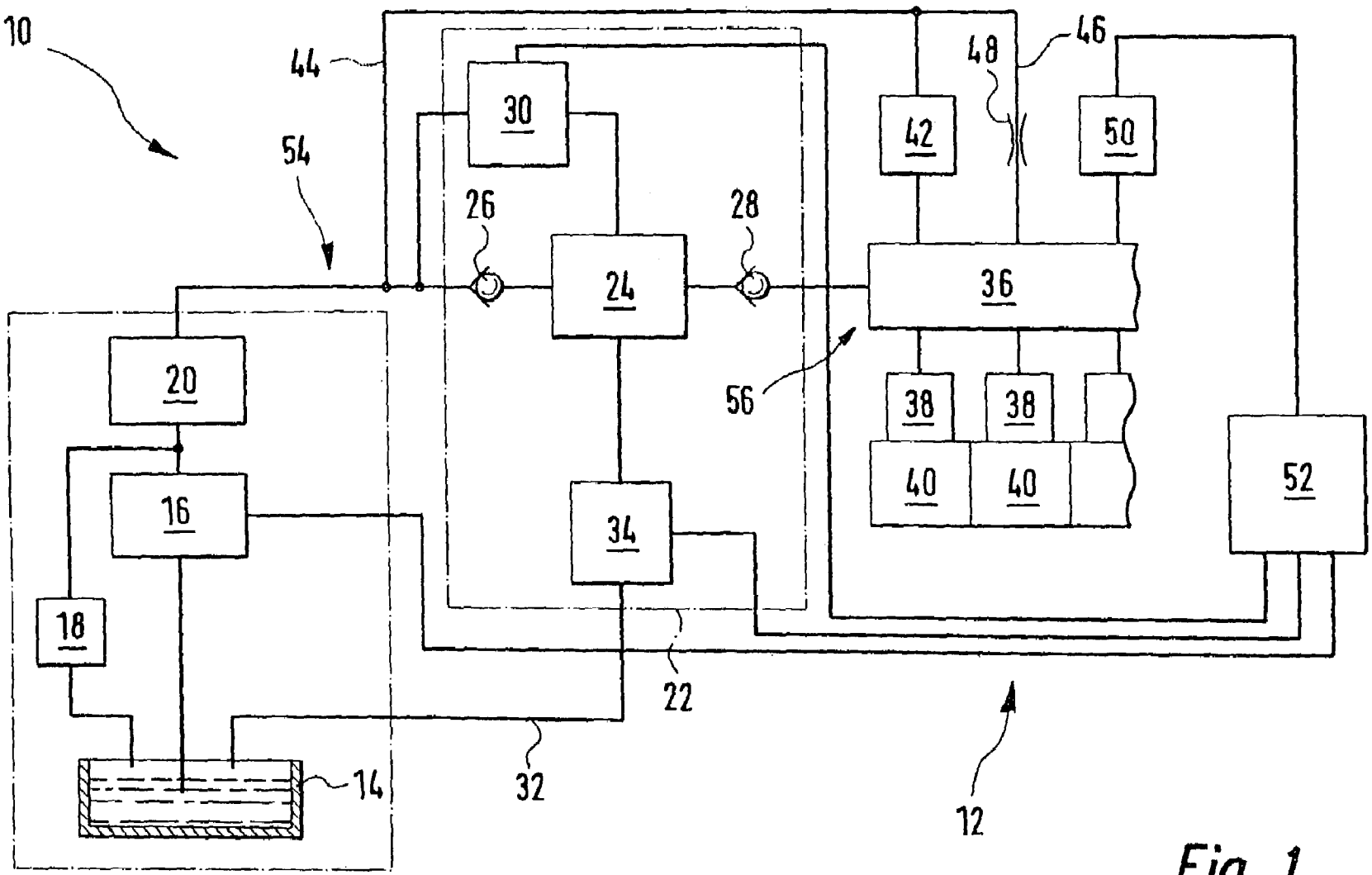
FIG. 1 a schematic representation of an internal combustion engine with a fuel system that includes a low-pressure region, a high-pressure region, and a release device that joins the high-pressure region with the low-pressure region.

In FIG. 1, a fuel system as a whole is labelled with reference numeral 10. It serves to supply an internal combustion engine 12 with fuel. Fuel system 10 includes a fuel tank 14, from which an electric fuel pump 16 pumps. The pressure that is downstream of electric fuel pump 16 is adjusting by a pressure regulator 18. Typically, this pressure is approximately 6 bar.

From electric fuel pump 16, the fuel passes through a filter 20 to a high-pressure fuel pump 22. This high-pressure fuel pump includes a pump interior 24, the size of which is a function of the position of a piston (not shown). The piston is driven directly by the camshaft (not shown) of internal combustion engine 12. Non-return valves 26 and 28 are provided upstream and downstream of pump interior 24. Pump interior 24 can be joined via a quantity control valve 30 with a region that is located upstream of non-return valve 26. Leakage fuel can flow back to fuel tank 14 via a leakage conduit 32. A shutoff valve 34 is located in leakage conduit 32.

High-pressure fuel pump 22 pumps into a fuel manifold 36, which is also generally referred to as a "rail". A plurality of fuel injection devices 38 are connected to this fuel rail. These fuel injection devices inject fuel into corresponding combustion chambers 40. The pressure in fuel manifold 36 is limited to a maximum value by a pressure limiter 42. From pressure limiter 42, a fuel line 44 leads to the region that is located between non-return valve 26 and electric fuel pump 16. A further fuel line 46 leads from fuel manifold 36 to fuel line 44. A flow restrictor 48 is located in it. The pressure in fuel manifold 36 is detected by a pressure sensor 50.

Pressure sensor 50 delivers corresponding signals to a control and/or regulating device 52. Control and/or regulating device 52 is connected on the output side to quantity control valve 30, shutoff valve 34 and electric fuel pump 16.

During normal operation of internal combustion engine 12, electric fuel pump 16 pumps the fuel with a pressure of approximately 6 bar to high-pressure fuel pump 22. The region between electric fuel pump 16 and non-return valve 26 is therefore also referred to as the low-pressure region, and it is labelled with reference numeral 54 in this case. High-pressure fuel pump 22 further pumps the fuel under very high pressure into fuel manifold 36. The pressure in this fuel manifold is 40 bar in this case, but it can also be much higher. The region that is located downstream of non-return valve 28 is referred to as high-pressure region 56.

Figure 2:
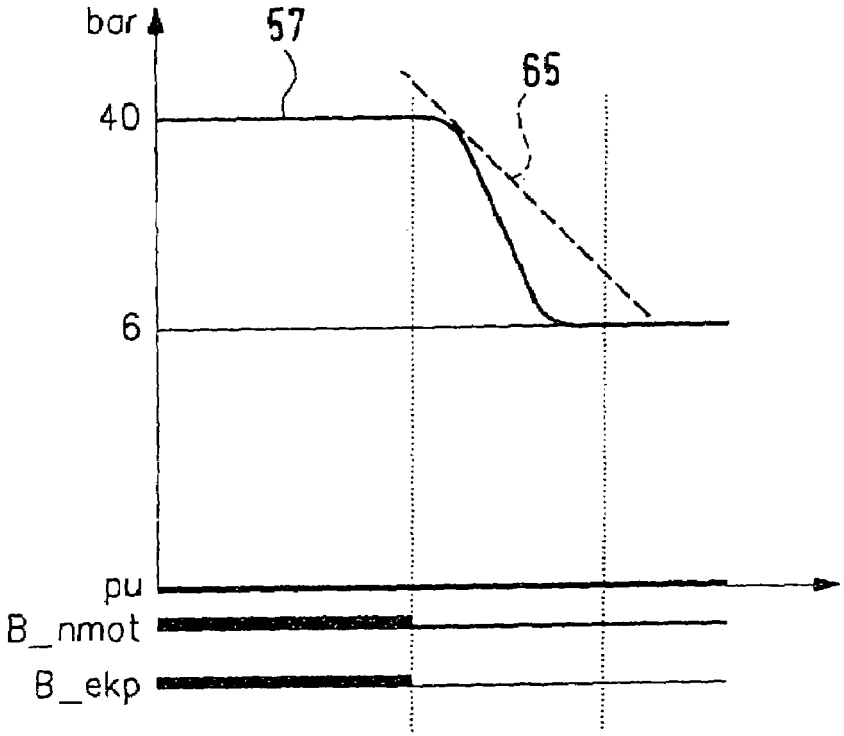
FIG. 2 a diagram that depicts the pressure gradient in the high-pressure region of the fuel system in FIG. 1 when the internal combustion engine is switched off and the release device is functioning.

If internal combustion engine 12 is switched off (FIGS. 2 and 3), a bit B_nmot becomes zero (end of the thick line). As a result, electric fuel pump 16 stops pumping fuel, i.e., the corresponding control bit B_EKP becomes zero as well. The injection of fuel into combustion chambers 40 by fuel injection devices 38 ends as well. In order to reduce the load on components, in particular fuel injection devices 38, that are located in high-pressure range 56, the pressure in high-pressure region 56 is relieved after internal combustion engine 12 is switched off.

Flow restrictor 48 and fuel line 46 are provided for this purpose. The fuel can flow through them from fuel manifold 36 toward low-pressure region 54. Since the pressure in low-pressure region 54 is kept at the normal operating pressure even when internal combustion engine 12 is switched off, to prevent the formation of vapor bubbles, the pressure in the high-pressure region drops to the level that exists in low-pressure region 54 (curve 57 in FIG. 2). In a not-shown exemplary embodiment, fuel line 46 is not joined with low-pressure region 54. Instead it is joined directly with fuel tank 14. In this case, the pressure in high-pressure region 56 would drop to ambient pressure.

The diameter of flow restrictor 48 is selected such that, when internal combustion engine 12 is switched off, the pressure in high-pressure region 56 can be relieved as quickly as possible. At the same time, however, it must be ensured that, during normal operation of internal combustion engine 12, the pressure in high-pressure region 56 can easily be kept at the desired high level. A typical value for the diameter of flow restrictor 48 is in the range of 0.1 mm. In a not-shown exemplary embodiment, an electrical switching valve is provided instead of the flow restrictor. Normally, this electrical switching valve blocks the connecting line to the low-pressure region. It is open with no current, when the internal combustion engine is switched off.

Figure 3:
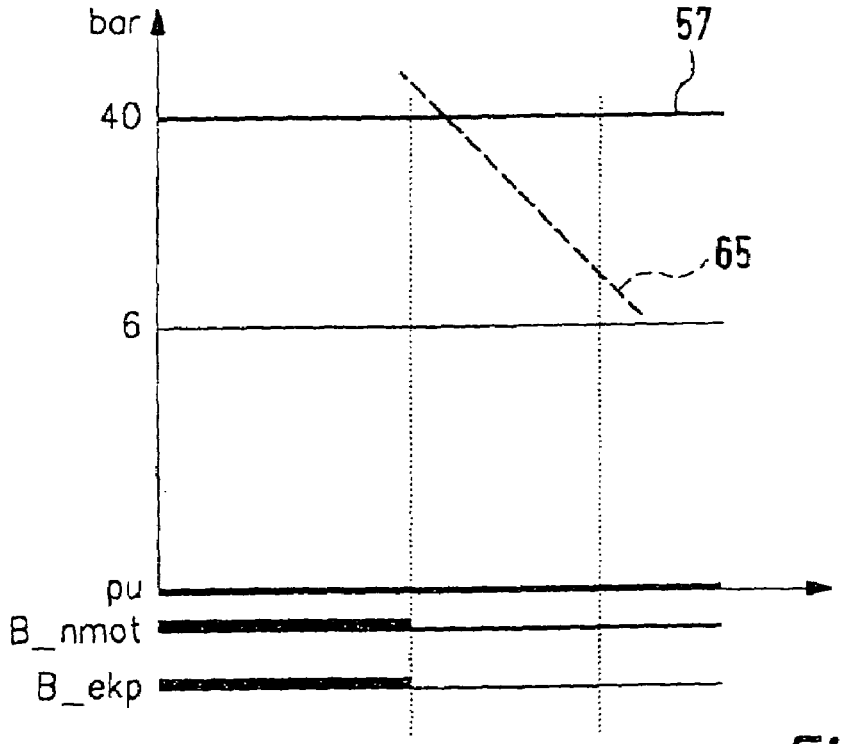
FIG. 3 a diagram similar to FIG. 2, but with a malfunctioning release device.
Figure 4:
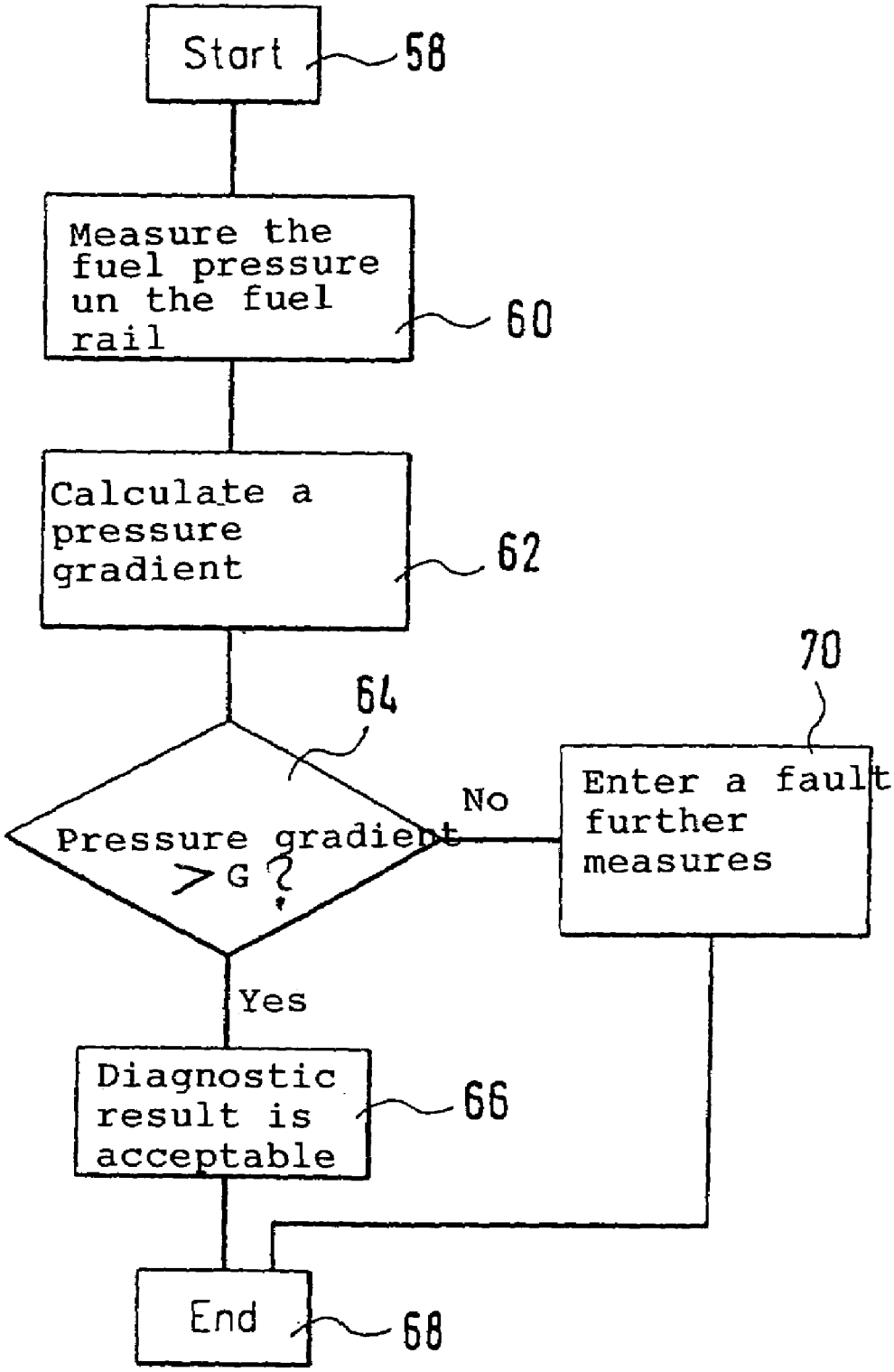
FIG. 4 a flow chart, in which a first exemplary embodiment of a method is depicted, with which the release device in FIG. 1 can be monitored.

Due to the particles suspended in the fuel, flow restrictor 48 can become clogged. In this case, the pressure in high-pressure region 56 cannot be relieved (FIG. 3). This can lead to a situation in which fuel passes into a combustion chamber 40 via leakage in a fuel injection device 38 while internal combustion engine 12 is idling. As a result, the emission behavior of the internal combustion engine upon restart is made worse. In addition, the pressure in high-pressure region 56 can increase when the fuel that is enclosed in the high-pressure region heats up and expands due to heat that is conducted from the engine block of internal combustion engine 12. For secure operation of internal combustion engine 12, it is important, therefore, that the functioning of flow restrictor 48 is monitored. A first possibility for monitoring of this nature is depicted in FIG. 4. The method, which is depicted there in a flow chart, is stored as a computer program in control and/or regulating device 52:

After a start block 58, the fuel pressure in fuel manifold 36 is measured in a block 60. This takes place via pressure sensor 50. The measurement is carried out at specified time intervals. In block 62, a pressure gradient is calculated from the individual measured values. A check is performed in block 64 to determine whether the pressure gradient is greater than a limiting value G (the dashed line in FIG. 2). If this is the case, this means that the pressure in high-pressure region 56 is being reduced at the desired rate, at the least. The result of the diagnosis is therefore acceptable (block 66). The method ends in block 68.

If, on the other hand, it is determined in block 64 that the pressure gradient is less than the limiting value G (FIG. 3), this means that the pressure in high-pressure region 56 is not being reduced in the desired manner. It can therefore be assumed that flow restrictor 48 is clogged. A fault is therefore entered in a fault storage in block 70. In addition, functions that rely on the correct functioning of flow restrictor 48 are shut off. This includes the diagnosis of shutoff valve 34, for example. In addition, a warning signal is output to the operator of internal combustion engine 12. If a motor vehicle is involved, for example, a warning light on the dashboard can illuminate. The fault storage can be read out when maintenance is performed, so that the individual who is performing the maintenance is informed immediately that flow restrictor 12 is not functioning properly.

Figure 5:
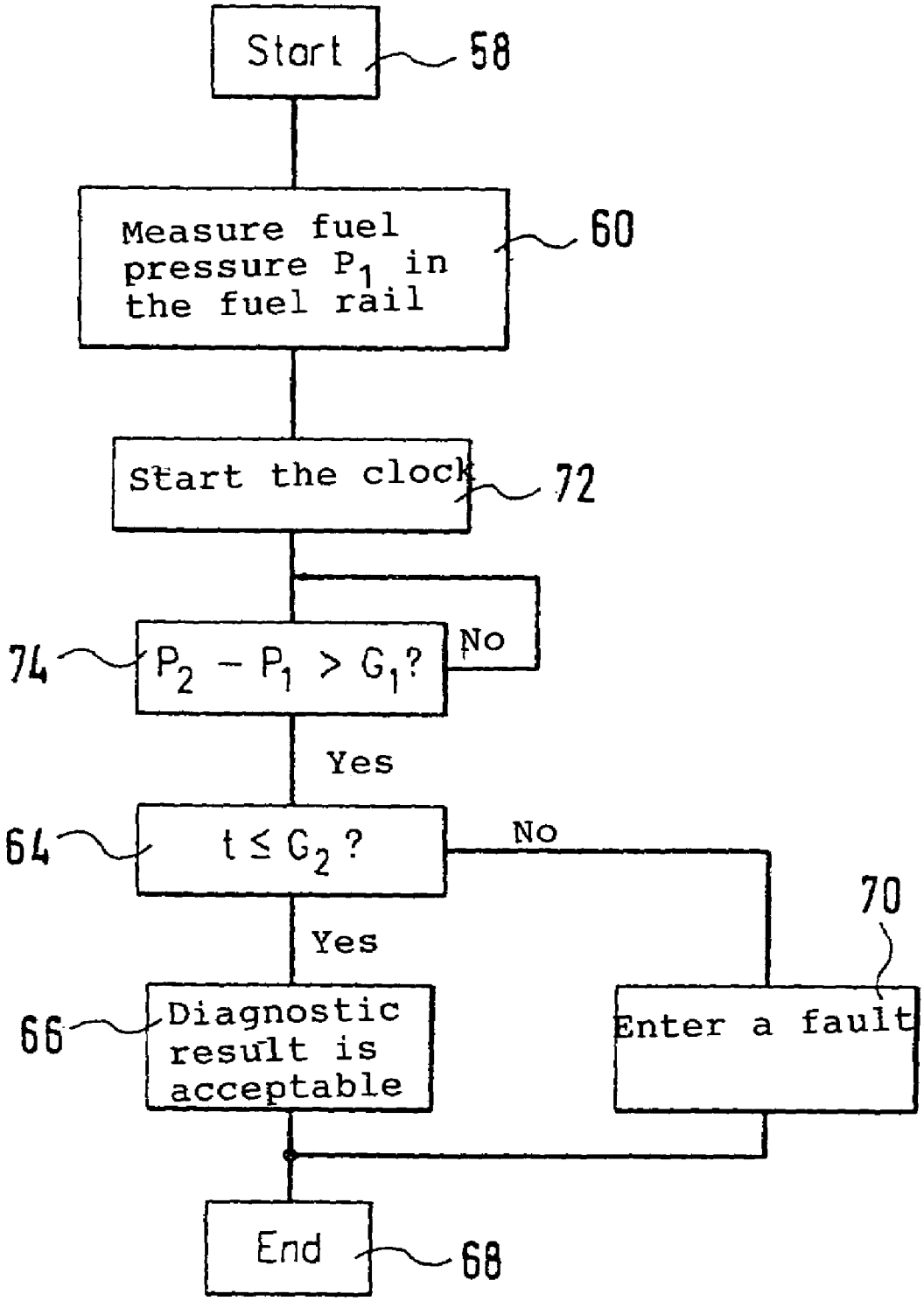
FIG. 5 a flow chart similar to FIG. 4, in which a second exemplary embodiment of a method for monitoring the release device in FIG. 1 is depicted.

A second exemplary embodiment of a method for monitoring flow restrictor 48 is depicted in FIG. 5. In this and the following exemplary embodiments, the same reference numerals are used for blocks that refer to equivalent functions in the blocks shown in FIG. 4. They are therefore not described again in detail.

With the method depicted in FIG. 5, the gradient itself is not monitored directly. Instead, fuel pressure P1 is measured first of all in block 60 at a certain point in time. At the same time, a clock is started in block 72. In block 74, the pressure in high-pressure region 56 and the corresponding pressure differential relative to the initial pressure measured in block 60 is continuously monitored. If the pressure differential exceeds a limiting value G1, a check is performed in block 64 to determine whether the time that passed until this pressure differential was reached is less than a limiting value G2. If this is the case, this means that the pressure differential was reached within the intended length of time, and flow restrictor 48 therefore functions properly. If the length of time t is greater than limiting value G2, however, too much time has passed for the required pressure differential to be reached; this indicates that flow restrictor 48 is not functioning properly.

Figure 6:
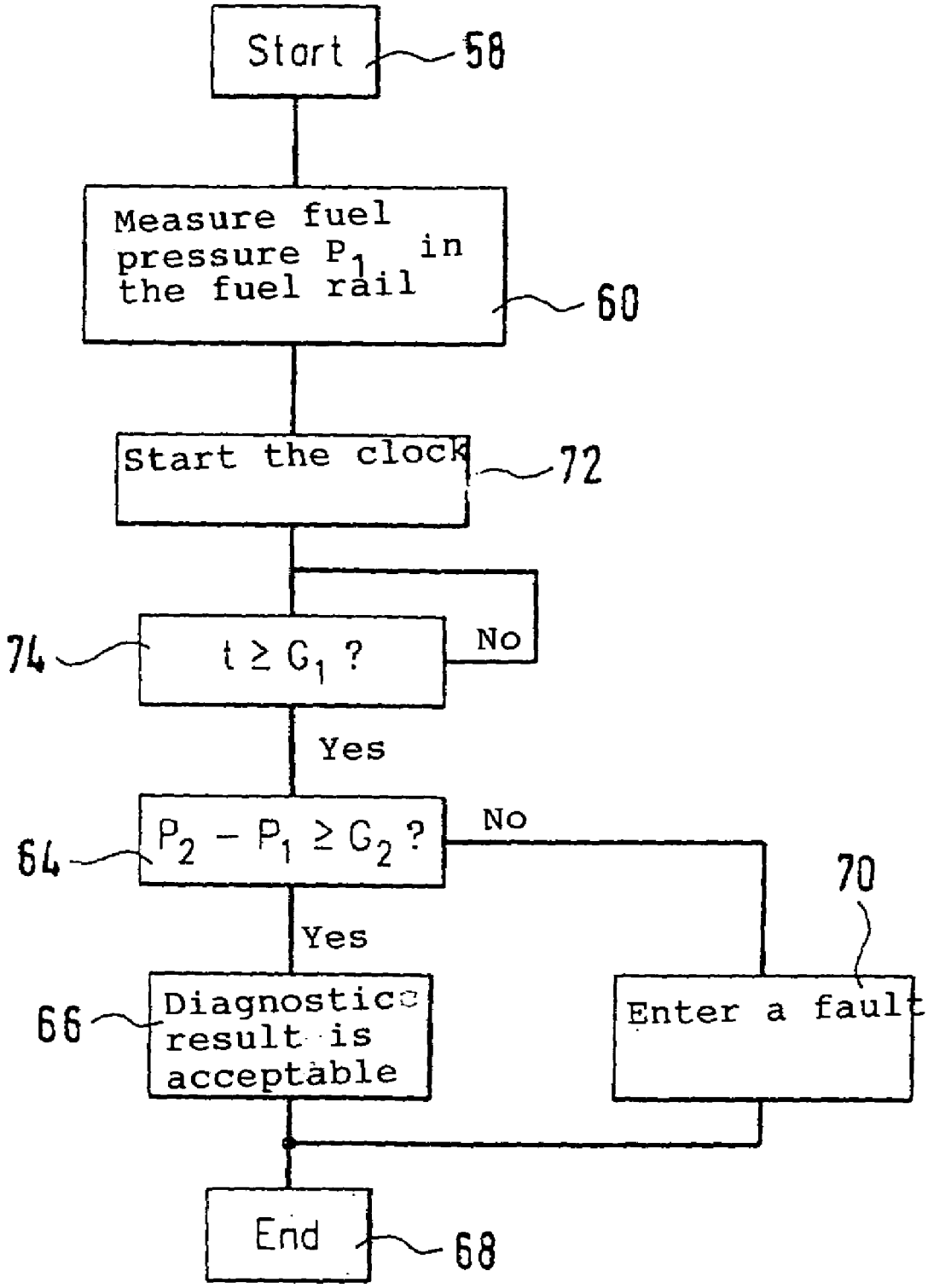
FIG. 6 a flow chart similar to FIG. 4, in which a third exemplary embodiment of a method for monitoring the release device in FIG. 1 is depicted.

With the exemplary embodiment depicted in FIG. 6, once a certain length of time has passed, a pressure differential that is measured in high-pressure region 56 within this period of time is compared with a limiting value G2. The length of time is established in block 74, and the pressure differential is compared with limiting value G2 in block 64. If the required pressure differential G2 was not reached within the specified length of time G1, this means that flow restrictor 48 is not functioning properly.

Figure 7:
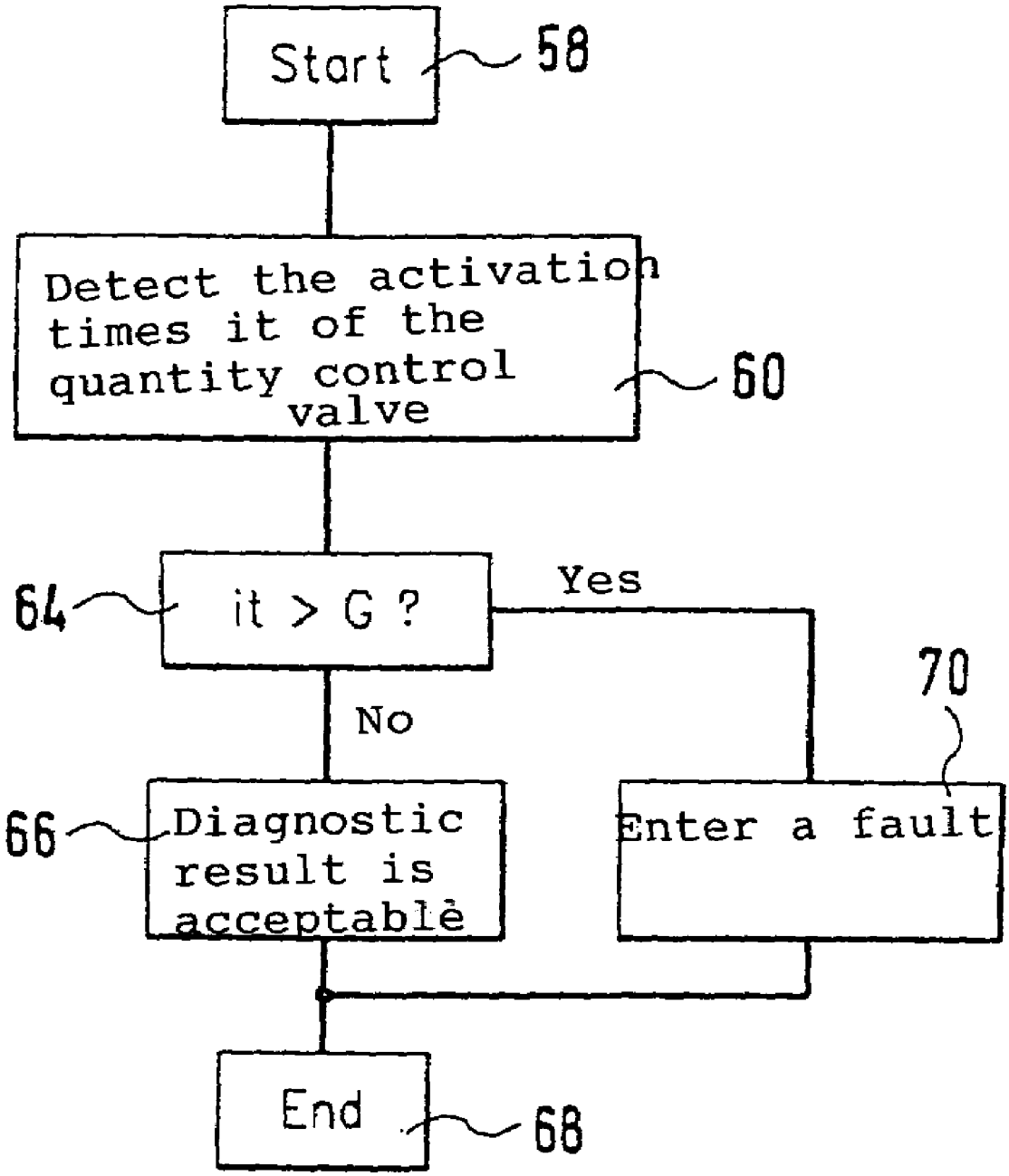
FIG. 7 a flow chart similar to FIG. 4, in which a fourth exemplary embodiment of a method for monitoring the release device in FIG. 1 is depicted.

A method is depicted in FIG. 7, with which the functioning of flow restrictor 48 is monitored in another fashion. In contrast to the methods depicted in FIGS. 4 through 6, it is assumed with the method depicted in FIG. 7 that the pressure in high-pressure region 56 should not be completely reduced to the level of the pressure in low-pressure region 54, but rather that it should be kept constant at a certain level that is clearly below the operating pressure in high-pressure region 56.

A method of this type is advantageous, for example, when internal combustion engine 12 operates in overrun. Since no fuel is being injected into combustion chambers 40 by fuel injection devices 38 in this case, fuel can only flow out of high-pressure region 56 via flow restrictor 48. In order to hold pressure constant, the fuel that is flowing out must be replaced by fuel delivered from high-pressure fuel pump 22. The quantity of fuel that is subsequently pumped can be deduced from the activation times and/or opening times of quantity control valve 30. With the method depicted in FIG. 7, the activation times of quantity control valve 30 are therefore detected in block 60, after start block 58. In block 64, a check is performed to determine whether the activation times it, as a whole, in total, are greater than a limiting value G. If this is the case, this means that the volumetric flow from high-pressure fuel pump 22 into high-pressure region 56 is low and, instead, a relevant amount of fuel is passing back into low-pressure region 54. As a result, it can be assumed that only a small amount of fuel is flowing out of high-pressure region 56 via flow restrictor 48 as well. This is also an indication that flow restrictor 48 is malfunctioning. Limiting value G in block 64 is a function of the rotational speed and the operating temperature of internal combustion engine 12.

What is claimed is:

1. A method of operating an internal combustion engine, comprising the steps of pumping a fuel from a first fuel pump to a second fuel pump and from there into a high-pressure region, from where the fuel passes into at least one combustion chamber of the internal combustion engine by using at least one fuel injection device; flowing the fuel out of the high pressure region via a flow restrictor; at teast indirectly monitoring a gradient according to which a pressure in the high-pressure region drops when said second fuel pump does not pump fuel, said fuel injection device does not operate, and the fuel flows out of the high-pressure region through said flow restrictor defining an operation status of the flow restrictor by evaluating the gradient.

2. The method as defined in claim 1; and further comprising monitoring a pressure differential by which the pressure in the high-pressure region drops, due to a release device, within a specified time in a certain operating condition of the internal combustion engine.

3. The method as defined in claim 1; and further comprising entering a fault in a fault storage and/or generating a warning signal if a gradient or a pressure differential or a volumetric flow is too low, or a time is too long.

4. The method as defined in claim 1; and further comprising selecting operating condition of the internal combustion engine, in which a release device is monitored, to include an overrun condition and/or a condition in which the internal combustion engine is switched off.

5. The method as defined in claim 1; and further comprising selecting a level of a limiting value used for monitoring pressure gradient as a function of an operating condition and/or at least one operating variable of the internal combustion engine.

6. A method of operating an internal combustion engine, comprising the steps of pumping a fuel from a first fuel pump to a second fuel pump and from there into a high-pressure region, from where the fuel passes into at least one combustion chamber of the internal combustion engine by using at least one fuel injection device: flowing the fuel out of the high pressure region via a flow restrictor; at least indirectly monitoring a gradient according to which a pressure in the high-pressure region drops when said second fuel pump does not pump fuel, said fuel injection device does not operate, and the fuel flows out of the high-pressure region through said flow restrictor defining an operation status of the flow restrictor by evaluating the gradient; and monitoring a time within which the pressure end in the high-pressure region drops, due to the release device, by a certain value in a certain operating condition of the internal combustion engine.

7. A method of operating an internal combustion engine, comprising the steps of pumping a fuel from a first fuel pump to a second fuel pump and from there into a high-pressure region, from where the fuel passes into at least one combustion chamber of the internal combustion engine; using for pumping at least one fuel injection device by using at least one fuel injection device; at least indirectly monitoring a gradient according to which a pressure in the high-pressure region drops when said second fuel pump does not pump fuel, said fuel injection device does not operate, and the fuel flows out of the high-pressure region through said flow restrictor defining an operation status of the flow restrictor by evaluating the gradient; entering a fault in a fault storage and/or generating a warning signal if a gradient or a pressure differential or a volumetric flow is too low or a time is too long; and shutting off functions that rely on a correct functioning of a release device than the fault is entered.

8. A method of operating an internal combustion engine, comprising the steps of pumping a fuel from a first fuel pump to a second fuel pump and from there into a high-pressure region, from where the fuel passes into at least one combustion chamber of the internal combustion engine by using at least one fuel injection device; and providing a flow of the fuel out of the high-pressure region via a flow restrictor defining an operation status of the flow restrictor by evaluating the gradient.

9. The method as defined in claim 8; and further comprising entering a fault in a fault storage and/or generating a warning signal if a gradient or a pressure differential or a volumetric flow is too low, or a time is too long.

10. The method as defined in claim 8; and further comprising selecting operating condition of the internal combustion engine, in which a release device is monitored, to include an overrun condition and/or a condition in which the internal combustion engine is switched off.

11. The method as defined in claim 8; and further comprising selecting a level of a limiting value used for monitoring pressure gradient as a function of an operating condition and/or at feast one operating variable of the internal combustion engine.

12. A method of operating an internal combustion engine, comprising the steps of pumping a fuel from a first fuel pump to a second fuel pump and from there into a high-pressure region, from where the fuel passes into at least one combustion chamber of the internal combustion engine; using at least one fuel injection device for the pumping; and providing a flow of the fuel out of the high-pressure region via a flow restrictor; and determining a volumetric flow based on an activation of a quantity control valve, with which a quantity of fuel delivered from the second fuel pump can be adjusted.

13. A method of operating an internal combustion engine, comprising the steps of pumping a fuel from a first fuel pump to a second fuel pump and from there into a high-pressure region, from where the fuel passes into at least one combustion chamber of the internal combustion engine by using at least one fuel iniection device; providing a flow of the fuel out of the high-pressure region via a flow restrictor; entering a fault in a fault storage and/or generating a warning signal if a gradient or a pressure differential or a volumetric flow is too low, or a time is too long; and further comprising shutting off functions that rely on, a correct functioning of a release device than the fault is entered.

* * * * *